US009929497B2

(12) United States Patent
Relue et al.

(10) Patent No.: US 9,929,497 B2
(45) Date of Patent: Mar. 27, 2018

(54) PLUG ASSEMBLY FOR A COMPRESSOR INCLUDING A CONDUIT ADAPTOR

(71) Applicant: Emerson Climate Technologies, Inc., Sidney, OH (US)

(72) Inventors: Gregory D. Relue, Tipp City, OH (US); David L. Landis, Ellijay, GA (US)

(73) Assignee: Emerson Climate Technologies, Inc., Sidney, OH (US)

( * ) Notice: Subject to any disclaimer, the term of this patent is extended or adjusted under 35 U.S.C. 154(b) by 42 days.

(21) Appl. No.: 15/229,836

(22) Filed: Aug. 5, 2016

(65) Prior Publication Data

US 2017/0125939 A1 May 4, 2017

Related U.S. Application Data

(60) Provisional application No. 62/250,725, filed on Nov. 4, 2015.

(51) Int. Cl.
*H01R 24/00* (2011.01)
*H01R 13/622* (2006.01)
(Continued)

(52) U.S. Cl.
CPC ..... *H01R 13/622* (2013.01); *H01R 13/5219* (2013.01); *H01R 13/567* (2013.01); *H01R 13/639* (2013.01); *H01R 31/06* (2013.01)

(58) Field of Classification Search
CPC ..... H01R 13/622; H01R 13/5219; H01R 13/639; H01R 31/06; H01R 13/567; Y10S 439/902
(Continued)

(56) References Cited

U.S. PATENT DOCUMENTS 3,675,184 A * 7/1972 Vetter ..... H01R 13/59 439/462
3,771,108 A * 11/1973 Haffner ..... H01R 13/6453 439/364
(Continued)

FOREIGN PATENT DOCUMENTS

JP 2006097557 A 4/2006

OTHER PUBLICATIONS

International Search Report regarding International Application No. PCT/US2016/060122, dated Feb. 17, 2017.
(Continued)

*Primary Examiner* — Tulsidas C Patel
*Assistant Examiner* — Travis Chambers
(74) *Attorney, Agent, or Firm* — Harness, Dickey & Pierce, P.L.C.

(57) ABSTRACT

A compressor including a shell including an opening; an electrical terminal engaging said opening and including a fence at least partially surrounding a plurality of first electrically conductive members; a plug including a plurality of second electrically conductive members in electrical communication with said first electrically conductive members, the plug including a threaded coupling unitary therewith; a plurality of wires extending from said second electrically conductive members through the threaded coupling; a conduit adapter including a first threaded surface for engagement with the threaded coupling, and a second threaded surface; and a threaded conduit engaging the second threaded surface to allow the plurality of wires to extend from the plug body, through the conduit adapter, and into the threaded conduit.

23 Claims, 14 Drawing Sheets

(51) Int. Cl.
*H01R 13/56* (2006.01)
*H01R 13/52* (2006.01)
*H01R 13/639* (2006.01)
*H01R 31/06* (2006.01)

(58) Field of Classification Search
USPC ..... 439/277, 468, 685, 694, 881, 902
See application file for complete search history.

(56) References Cited

U.S. PATENT DOCUMENTS 4,795,360 A * 1/1989 Newman ..... H01R 13/5221 439/277
4,857,006 A * 8/1989 Linyeav ..... H01R 13/533 439/271
6,746,279 B1 * 6/2004 Lopez ..... H01R 9/2458 439/620.01
7,344,400 B2 3/2008 Hasegawa
7,507,125 B2 * 3/2009 Okamura ..... H01R 13/506 439/680
8,047,862 B2 * 11/2011 Lilie ..... H01R 13/5219 439/271
8,288,667 B2 * 10/2012 Chiou ..... H02G 3/0658 174/652
8,496,494 B2 * 7/2013 Jordan ..... H01R 9/032 439/349
8,721,371 B2 * 5/2014 Picker ..... H01R 13/58 429/468
8,851,923 B2 * 10/2014 Klaassen ..... H01R 13/521 439/587
8,919,221 B2 * 12/2014 Chiou ..... F16C 1/102 174/520
8,939,734 B2 * 1/2015 Hoying ..... F04B 39/121 417/410.1
2003/0151861 A1 8/2003 Moore et al.
2006/0068626 A1 3/2006 Hasegawa
2009/0060749 A1 3/2009 Hoying et al.
2011/0076162 A1 * 3/2011 Heidecker ..... F04B 39/121 417/313
2012/0302100 A1 11/2012 Picker et al.
2014/0097023 A1 4/2014 Dinh et al.

OTHER PUBLICATIONS

Written Opinion of the International Searching Authority regarding International Application No. PCT/US2016/060122, dated Feb. 17, 2017.

* cited by examiner

PLUG ASSEMBLY FOR A COMPRESSOR INCLUDING A CONDUIT ADAPTOR

CROSS-REFERENCE TO RELATED APPLICATIONS

This application claims the benefit of U.S. Provisional Application No. 62/250,725 filed on Nov. 4, 2015. The entire disclosure of the above application is incorporated herein by reference.

FIELD

The present disclosure relates to an electrical-plug assembly and an adaptor for connecting a conduit to the plug assembly.

BACKGROUND

This section provides background information related to the present disclosure and is not necessarily prior art.

Electrically powered components may include at least one terminal assembly for electrically coupling the component to an external source of electrical power. A plug assembly may engage the terminal assembly to electrically couple a plurality of wires communicating with the source of electrical power to the terminal assembly to selectively supply the component with electrical power.

SUMMARY

This section provides a general summary of the disclosure, and is not a comprehensive disclosure of its full scope or all of its features.

According to a first aspect of the disclosure, an assembly is provided including a plug body encasing a plurality of electrical receptacles and first ends of a plurality of wires electrically connected to the electrical receptacles, the plug body including a threaded coupling unitary therewith; a conduit adapter including a first threaded surface for engagement with the threaded coupling, and a second threaded surface; and a threaded conduit engaging the second threaded surface to allow the plurality of wires to extend from the plug body, through the conduit adapter, and into the threaded conduit.

According to a second aspect of the disclosure, a compressor may include a shell including an opening; an electrical terminal engaging the opening and including a fence at least partially surrounding a plurality of first electrically conductive members; a plug including a plurality of second electrically conductive members in electrical communication with the first electrically conductive members, the plug including a threaded coupling unitary therewith; a plurality of wires extending from said second electrically conductive members through the threaded coupling; a conduit adapter including a first threaded surface for engagement with the threaded coupling, and a second threaded surface; and a threaded conduit engaging the second threaded surface to allow the plurality of wires to extend from the plug body, through the conduit adapter, and into the threaded conduit.

According to a third aspect of the disclosure, an assembly is provided including a terminal body including a plurality of conductor pins; a fence having a through-hole formed therein, the fence surrounding the terminal body; a plug body encasing a plurality of electrical receptacles for engagement with the plurality of conductor pins; a latching device extending from the plug body and configured to engage with the through-hole of the fence to secure the plug body to the fence and prevent disengagement between the plurality of conductor pins and plurality of electrical receptacles; a plurality of wires electrically connected to the electrical receptacles, and passing through a threaded coupling unitary with the plug body; a conduit adapter including a first threaded surface for engagement with the threaded coupling, and a second threaded surface; and a threaded conduit engaging the second threaded surface to allow the plurality of wires to extend from the plug body, through the conduit adapter, and into the threaded conduit.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
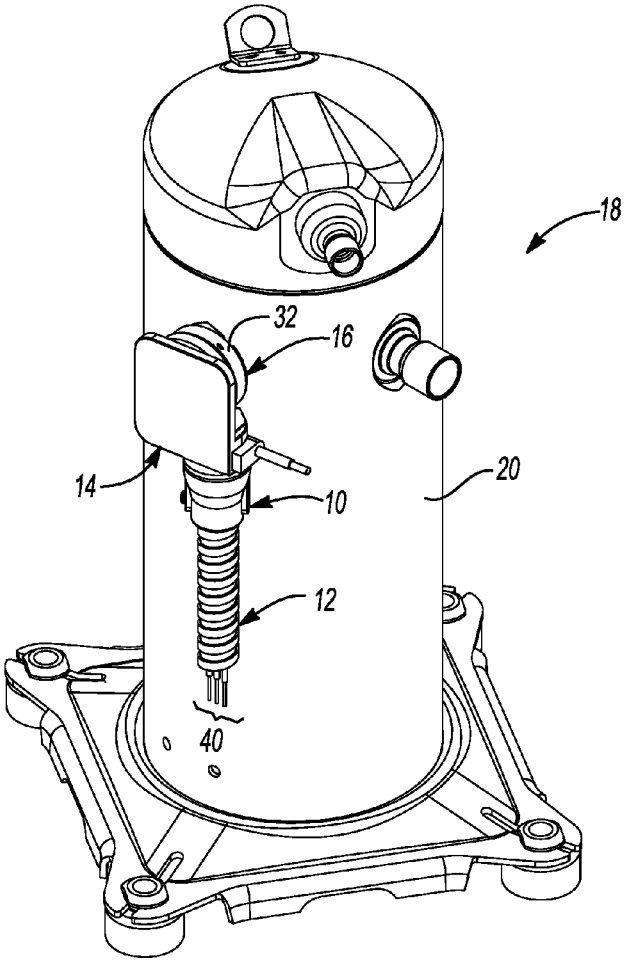
FIG. 1 is a perspective view of a compressor having a plug assembly and conduit adaptor connected thereto.
Figure 2:
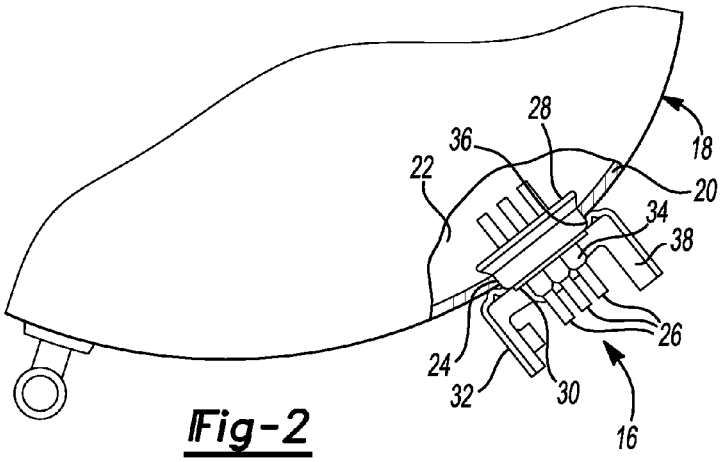
FIG. 2 is a partial cross-sectional view of a terminal of the compressor.
Figure 3:
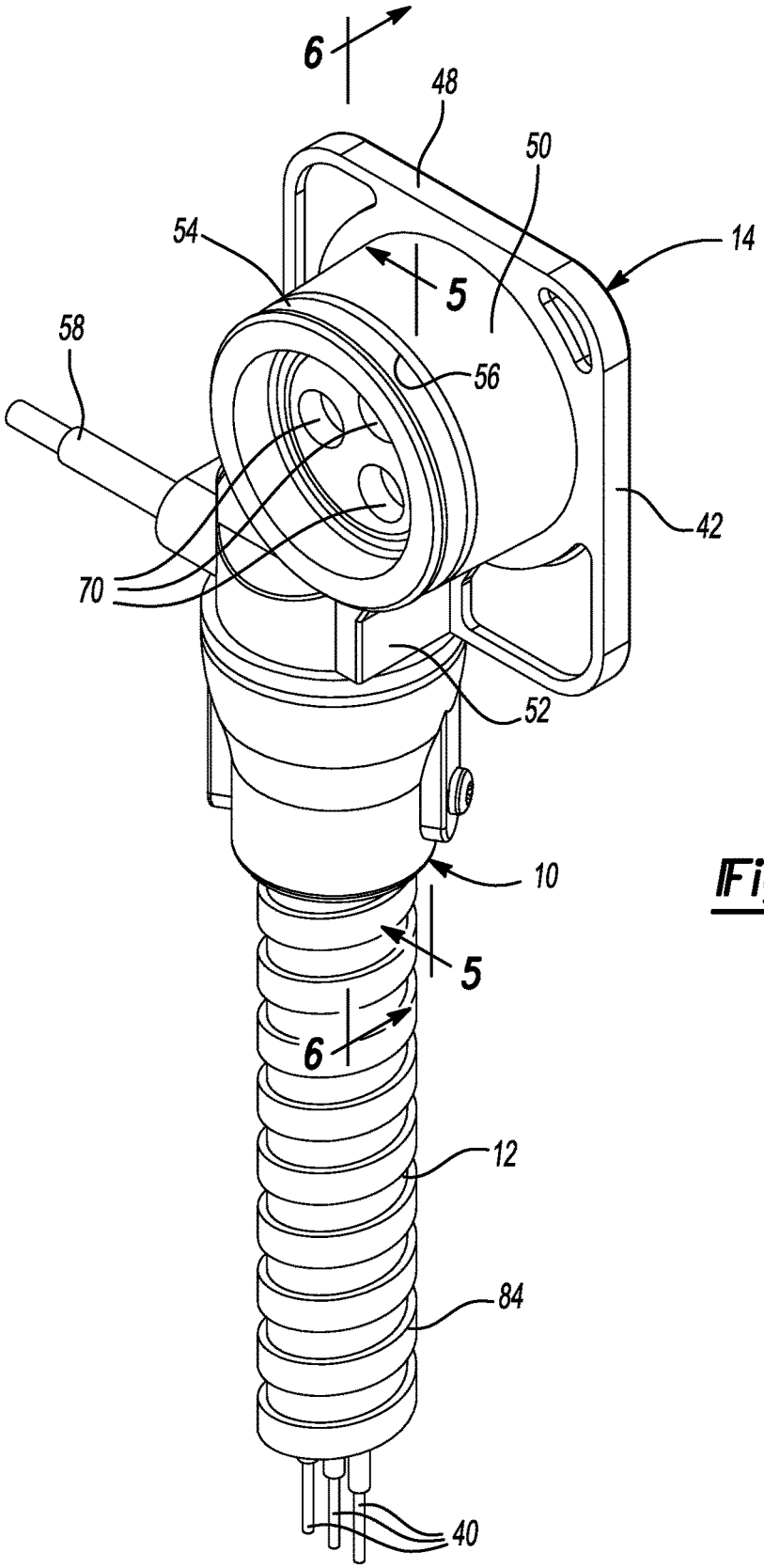
FIG. 3 is a perspective view of the plug assembly, conduit adapter, and conduit in a connected configuration.
Figure 4:
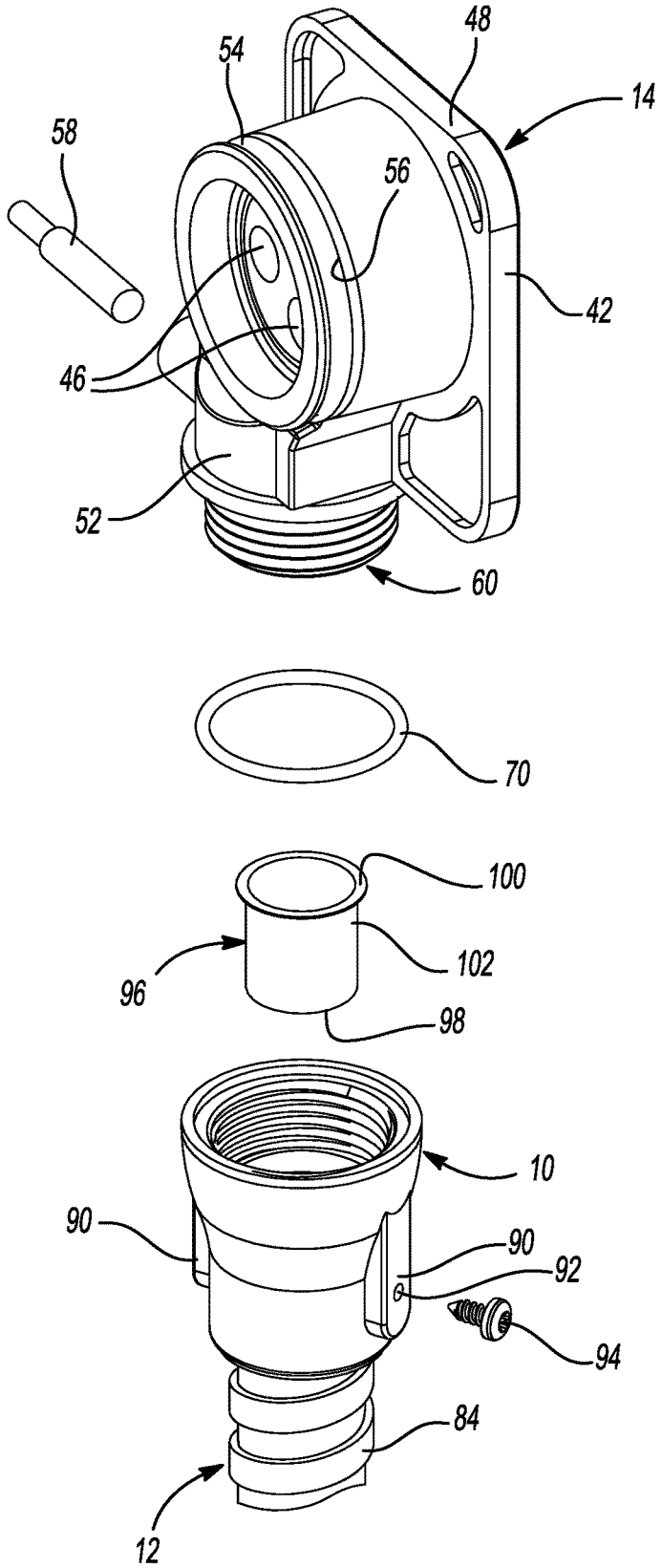
FIG. 4 is an exploded perspective view of the plug assembly and conduit adaptor.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIGS. 1-6, a conduit adaptor 10 is provided that may couple a conduit 12 to a plug assembly 14. The plug assembly 14 may electrically couple an electrical terminal 16 to a source of electrical power (not shown). The terminal 16 may be electrically connected to a load such as a motor (not shown) of an electrically powered component or module, such as a compressor 18, for example, or any other electrically powered component or module including a control and/or diagnostic module, a circuit board, a fan, a heater or a sensor.

The terminal 16 is electrically coupled to an exemplary load, which will be described in the context of the compressor 18 depicted in FIG. 1, with the understanding that this is an example and that the conduit adaptor 10 may be used with any other load. The compressor 18 may be a scroll compressor, a linear compressor, a screw compressor, a centrifugal compressor, or a reciprocating compressor, for example, or any other type of compressor.

The compressor 18 may compress a refrigerant or other working fluid and circulate the working fluid throughout a cooling system or heat pump system, for example. The compressor 18 may include a shell 20 defining a sealed chamber 22 within which the motor and a compression mechanism (not shown) may be disposed. The terminal 16 may be sealingly disposed within an aperture 24 that extends through the shell 20. The sealed relationship between the terminal 16 and the shell 20 maintains the integrity of the sealed chamber 22 and may provide the chamber 22 with a hermetic seal. The terminal 16 may provide for the electrical connection between an external source of electrical power (not shown) and the motor disposed within the chamber 22.

The terminal 16 may include a plurality of conductor pins 26, a terminal body 28, a plurality of fused-glass and/or ceramic insulators (not specifically shown), a silicone-rubber molding 30, and a fence 32. The terminal body 28 may be a cup-shaped metallic member that may be sealingly disposed within the aperture 24 by resistance welding and/or any other suitable attachment method. Each of a plurality of apertures (not shown) extending through the terminal body 28 may sealingly receive a respective one of the plurality of fused-glass insulators and a respective one of the plurality of conductor pins 26. Each conductor pin 26 may extend through a respective fused-glass insulator to provide electrical communication between an exterior and interior of the shell 20.

Each of the ceramic insulators may be secured to a respective one of the plurality of conductor pins 26 that extends into the chamber 22. The ceramic insulators may insulate the conductor pins 26 from contact with the terminal body 28 as well as provide insulation between adjacent conductor pins 26. The silicone-rubber molding 30 may be located on an outside of the terminal body 28 and may include a plurality of upstanding jackets 34 extending therefrom. Each of the upstanding jackets 34 may include an aperture extending through the silicone-rubber molding 30 and may receive a respective one of the conductor pins 26.

The fence 32 may be physically secured to the outside of the shell 20 by resistance welding and/or any other suitable attachment method. In this regard, the terminal body 28 and the fence 32 may be simultaneously or sequentially welded to the shell 20 to provide a hermetic seal. The fence 32 may extend outward from the shell and may at least partially surround the conductor pins 26. The fence 32 may include an opening 36 that engages the terminal body 28 to locate the fence 32 on the shell 20 and to locate the fence 32 with respect to the conductor pins 26. Locating the fence 32 with respect to the conductor pins 26 allows for a close fit between the plug assembly 14 and both the terminal 16 and the fence 32. The fence 32 may include a cavity 38 within which the conductor pins 26 may be located. Attachment between the fence 32 and the plug assembly 14 provides a seal that restricts or prevents moisture and/or debris from leaking therebetween and causing corrosion of the conductor pins 26.

The plug assembly 14 allows for the connection of the portion of the conductor pins 26 located outside of the shell 20 to a plurality of wires 40 that extend between the plug assembly 14 and the external supply of electrical power. The plug assembly 14 may include a molded-outer body 42 surrounding a molded-inner core 44. Such a configuration is more fully described in U.S. Pat. No. 8,939,734 assigned to Emerson Climate Technologies, Inc., which is hereby incorporated by reference in its entirety. The outer body 42 and the inner core 44 may be formed from rigid and flame-resistant thermoset or thermoplastic materials such as, for example, polyethylene terephthalate, polyamide 4, 6, and polyamide 6, 6. These materials may include a glass fiber filler. The inner core 44 may include female-electrical receptacles 46 for receiving respective conductor pins 26. The plurality of receptacles 46 are equal in number to and arranged in the same pattern as the conductor pins 26 of terminal 16. The connection between the conductor pins 26 and the receptacles 46 provides for both an electrical connection between the conductor pins 26 and receptacles 46 as well as a mechanical connection that maintains the plug assembly 14 in a desired position relative to the terminal 16 and fence 32. The inner core 44 may position the wires 40 relative to the receptacles 46 to allow the wires to be in electrical communication with the conductor pins 26 when the conductor pins 26 are received within the receptacles 46.

Figure 5:
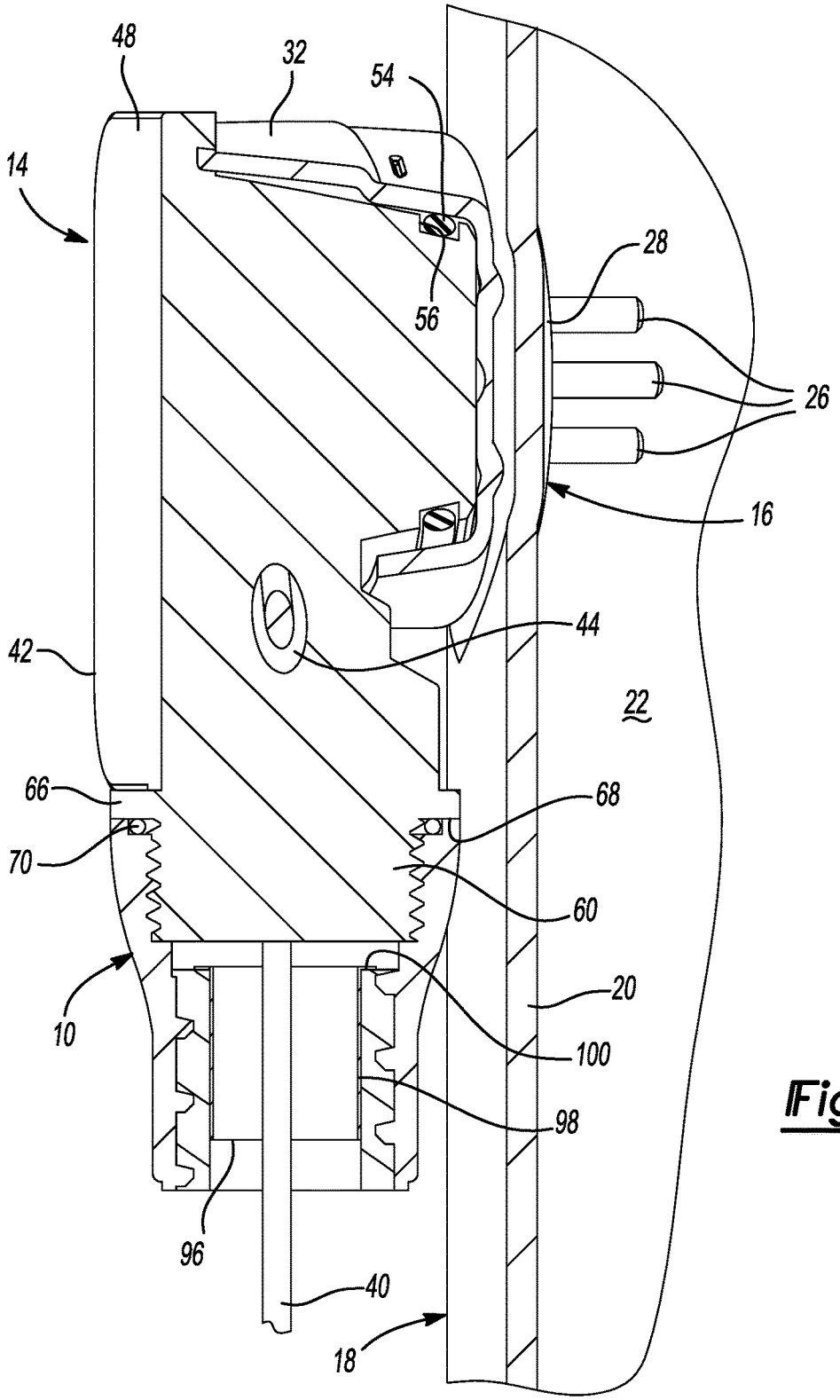
FIG. 5 is a partial cross-sectional view of the plug assembly and conduit adaptor, with the plug assembly connected to the terminal of the compressor.
Figure 6:
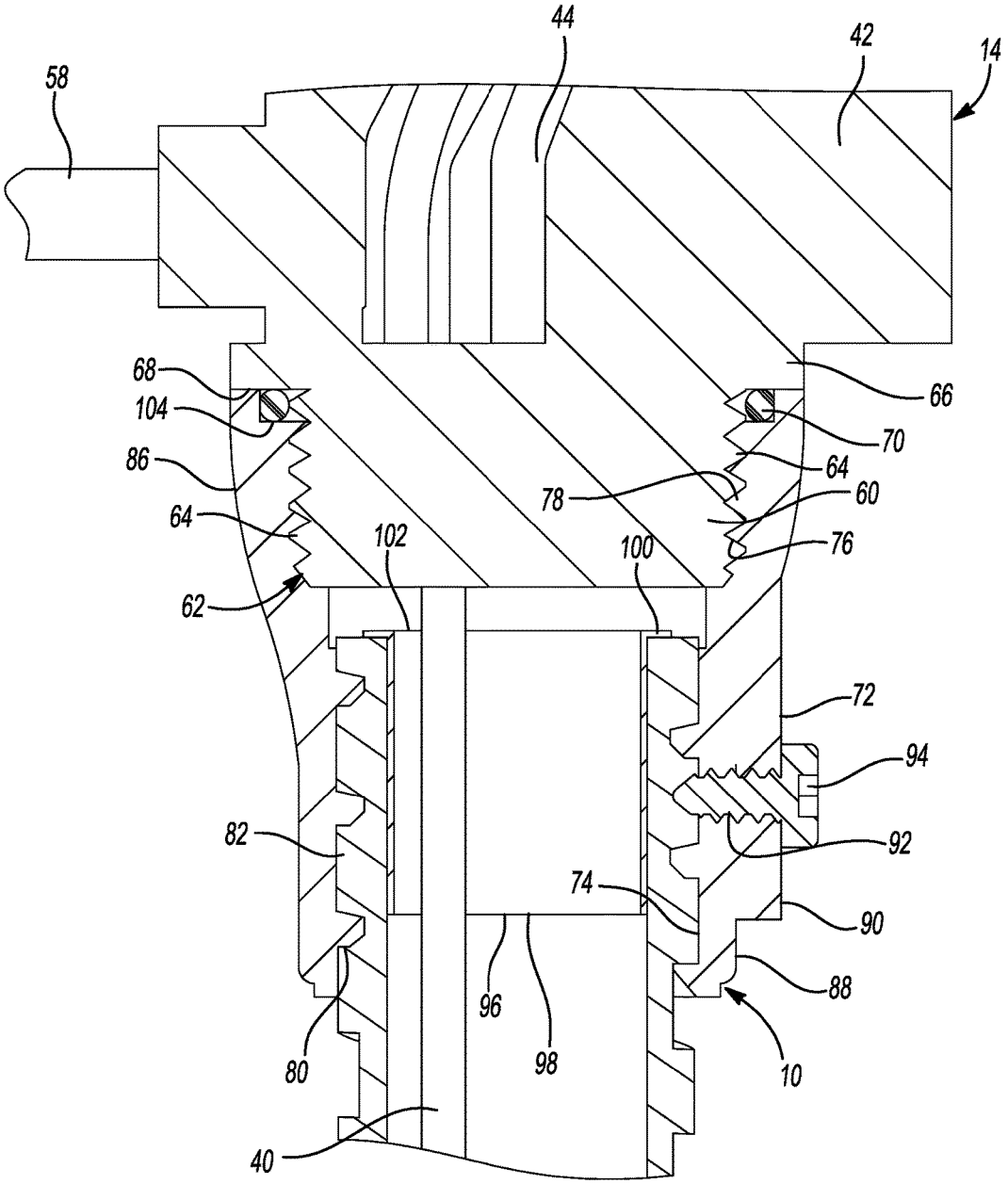
FIG. 6 is a cross-sectional view of the plug assembly and the conduit adaptor.
Figure 7:
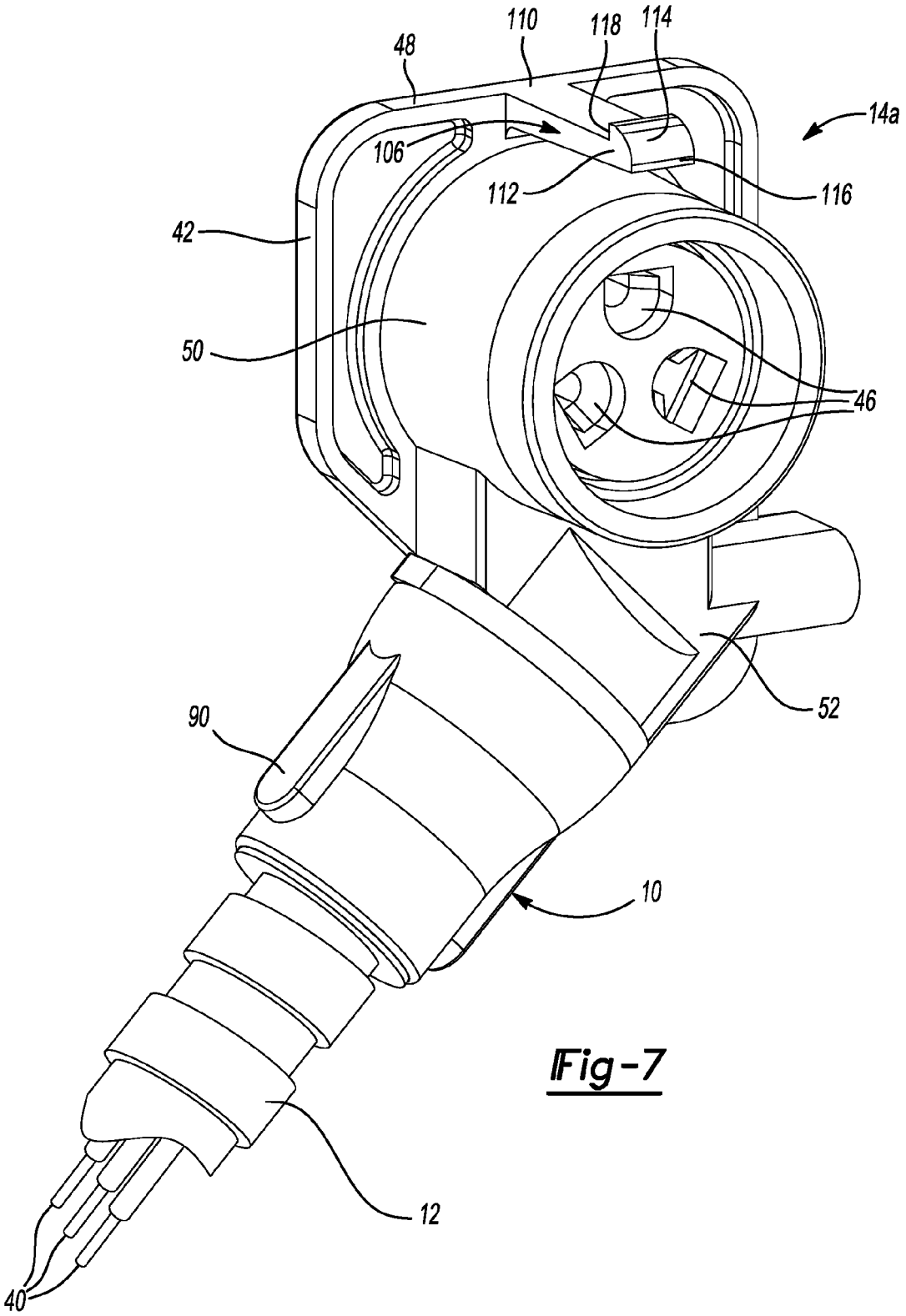
FIG. 7 is a perspective view of a plug assembly including a conduit adapter according to a second aspect of the present disclosure.
Figure 8:
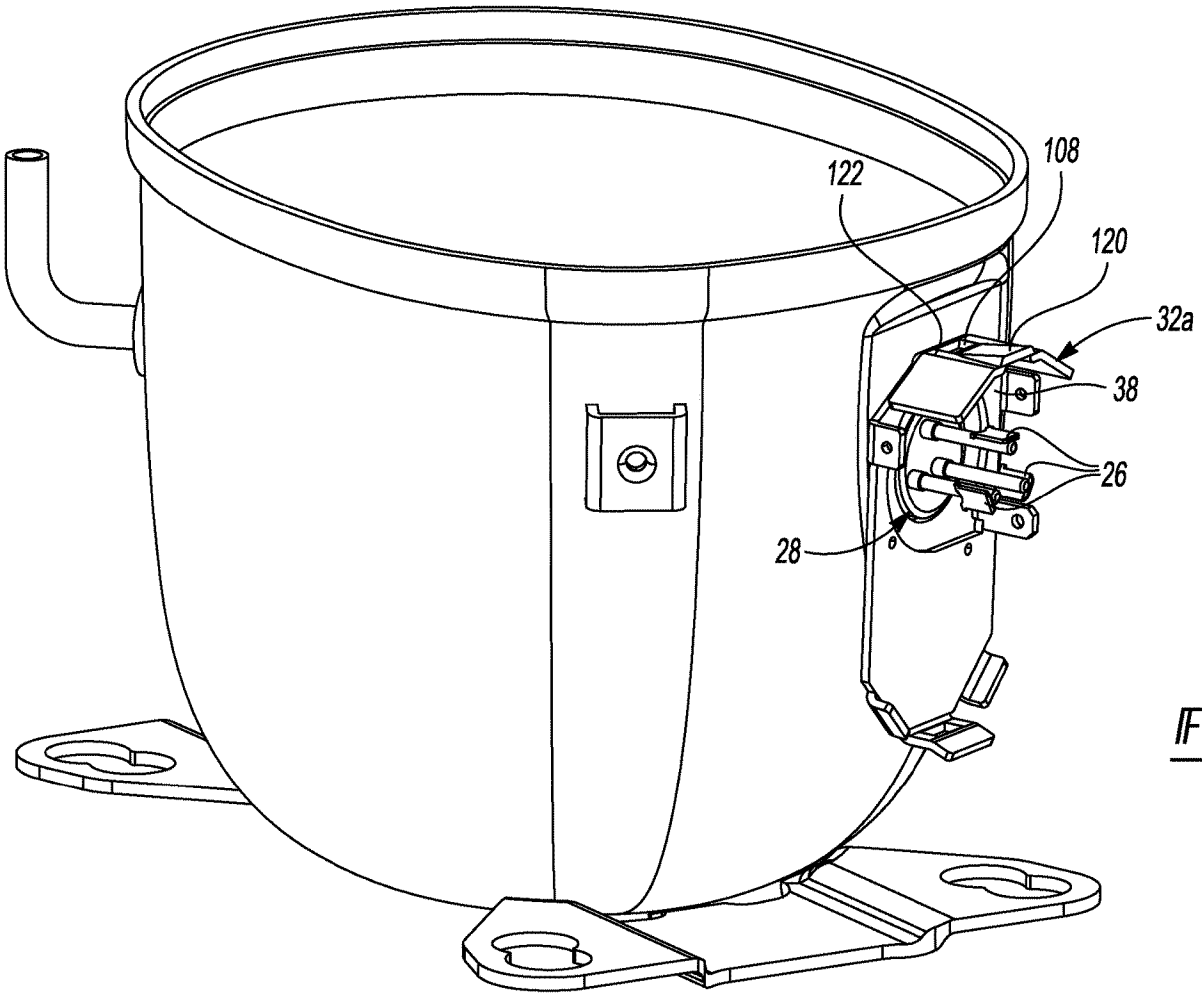
FIG. 8 is a perspective view of an example compressor shell and terminal assembly for use with the plug assembly illustrated in FIG. 7.
Figure 9:
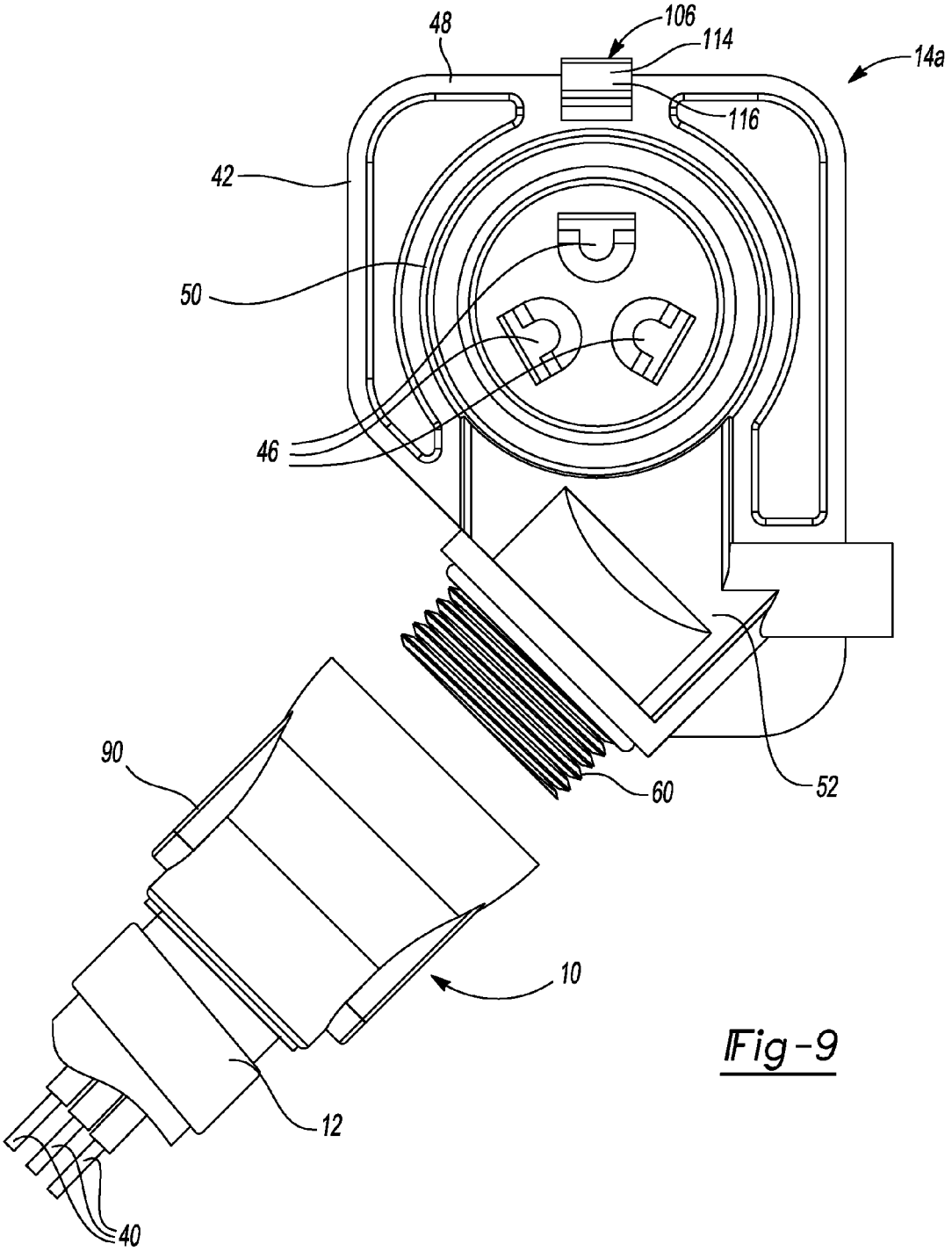
FIG. 9 is an exploded perspective view of the plug assembly illustrated in FIG. 7.

The outer body 42 may include an end cap 48, a connector body 50, and a housing cover 52 that may surround the inner core 44. The end cap 48 may seat against a distal edge of the fence 32 when the plug assembly 14 is fully engaged with the terminal 16. The connector body 50 extends from the end cap 48 into the fence 32 and may include an annular seal 54 (FIG. 5). The seal 54 may sealingly engage an inner diametrical surface of the fence 32 when the plug assembly 14 is fully engaged with the terminal 16. For example only, the seal 54 may be an O-ring, square ring or D-ring and may be disposed in an annular groove 56 in the connector body 50. The receptacles 46 may extend through an axially facing surface of the connector body 50. The housing cover 52 may extend from the end cap 48 and the connector body 50 and may house a portion of the inner core 44 that positions the wires 40. A ground wire 58 may extend outward from housing cover 52.

In some embodiments, the fit between the terminal 16 and the plug assembly 14 may be tight enough to retain the plug assembly 14 on the terminal 16. In some embodiments, the plug assembly 14 may include an optional plug retainer that may be selectively attached to the fence 32 to restrict removal of the plug assembly 14 from the fence 32. An exemplary plug retainer is described in U.S. Pat. No. 8,721,371 assigned to Emerson Climate Technologies, Inc., the entire contents of which is hereby incorporated by reference.

To reliably secure plug assembly 14 to conduit 12 via adapter 10, plug assembly 14 includes a coupling 60. Coupling 60 is unitarily formed with plug assembly 18. That is, coupling 60 is formed along with plug molded outer body 42 during manufacture of plug assembly 18. Coupling 60, therefore, is also formed from a thermoset or thermoplastic material, for example. Coupling 60 includes a threaded outer body 62 having male threads 64. A radially extending flange 66 extends away from threaded outer body 62 at a location between threaded outer body 62 and plug molded outer body 42. Radially extending flange 66 provides a shoulder or seat 68 for a polymeric sealing member or O-ring 102. Sealing member 70 seals the interface between coupling 60 and adapter 10 upon connection between coupling 60 and adapter 10 to prevent the migration of moisture, dust, or debris into plug assembly 14, as will be described in more detail below.

Conduit adapter 10 is a hollow member including an exterior surface 72 and an interior surface 74. Similar to plug assembly 14, conduit adapter 10 may be formed from, for example, a thermoset or thermoplastic material such as a glass-reinforced polyethylene terephthalate. Interior surface 74 of conduit adapter 10 includes a first threaded surface 76 having female threads 78 that are configured to mate with male threads 64 of coupling 60. In addition, interior surface 74 includes a second threaded surface 80 having female threads 82 configured to mate with male threads 84 of conduit 12. In this regard, female threads 82 and male threads 84 of conduit 12 have a greater width in comparison to male threads 64 of coupling 60 and female threads 78 of first threaded surface 76. Male threads 64 of coupling 60 may be designed to mate with female threads 78 of conduit adapter 10 in a manner such that clockwise rotation of conduit adapter 10 relative to coupling 60 tightens connection therebetween, and counterclockwise rotation loosens connection therebetween. Similarly, male threads 84 of conduit 12 and female threads 82 of conduit adapter 10 may be designed to mate in a manner such that clockwise rotation of conduit 12 relative to conduit adapter 10 tightens connection therebetween, and counterclockwise rotation loosens connection therebetween. It should be understood, however, that male threads 84 of conduit 12 and female threads 82 of conduit adapter 10 may be designed such that counterclockwise rotation of conduit 12 relative to conduit adapter tightens connection therebetween, and clockwise rotation loosens without departing from the scope of the present disclosure.

Exterior surface 72 includes a first or proximate portion 86, and a second or distal portion 88. Proximate portion 86 may have a greater outer diameter in comparison to that of distal portion 88. A pair of elongate ribs 90 project outward from exterior surface 72. One or both of ribs 90 may include a threaded aperture 92 for receipt of a fastener or screw 94. In this manner, when conduit 12 is threadingly engaged with second threaded surface 80, conduit 12 may be further secured to conduit adapter 10 by engaging screw 94 with conduit 12 through aperture 92. It should be noted that engagement of screw 94 with conduit 12 through aperture 92 is optional. Regardless, if screw 94 is engaged with conduit 12, it should be noted that screw 94 does not pierce conduit 12, but rather crimps conduit 12 to more robustly attach conduit 12 to conduit adapter 10.

A bushing 96 may be placed within conduit adapter 10 before threadingly attaching conduit adapter 10 and conduit 12, and then threadingly attaching conduit adapter 10 to coupling 60. Bushing 96 is a polymeric member including a cylindrical body 98 and lip 100 extending from an end 102 thereof. Lip 100 is designed to sit over a terminal end of conduit 12. More particularly, conduit 12 may be formed of a metal material such as aluminum, steel, or some other type of metal material. Alternatively, conduit 12 may be formed of a polymeric material. Regardless, the terminal end of conduit 12 can damage wires 40 during attachment of conduit 12 to plug assembly 14. Because lip 100 sits over the terminal end of conduit 12, however, the terminal end of conduit 12 is prevented from contacting wires 40.

Attachment of conduit 12 to conduit adapter 10 and, subsequently, to plug assembly 14 will now be described. First, conduit adapter 10 is threadingly engaged to conduit 12. In this regard, conduit adapter 10 including bushing 96 is mated to conduit 12 such that male threads 84 of conduit 12 are engaged with female threads 82 of second threaded surface 80. Conduit adapter 10 is then rotated relative to conduit 12 to fully thread conduit adapter 10 onto conduit 12. In this regard, ribs 90 may be gripped to assist in rotating conduit adapter 10 relative to conduit 12. If desired, screw 94 may then threaded into aperture 92 to engage conduit 12 and lock conduit adapter 10 relative to conduit 12.

Next, plug assembly 14 including unitary coupling 60 is connected conduit adapter 10. O-ring 70 is first seated over male threads 64 and against shoulder 68. Then, wires 40 extending from coupling 60 may be inserted through conduit adapter 10 and into conduit 12. As noted above, bushing 96 is positioned within conduit adapter 10 over conduit 12. Accordingly, wires 40 are prevented from contacting a terminal end of conduit 12, which assists in preventing damage to wires 40 during connection between conduit 12 and plug assembly 14 via conduit adapter 10. Then, coupling 60 is threadingly engaged with conduit adapter 10 such that male threads 64 engage with female threads 78 of conduit adapter 10. Plug assembly 14 is then rotated to fully seat coupling 60 within conduit adapter 20, and partially compress O-ring 70 between shoulder 68 and an annular surface 104 formed within conduit adapter 10.

Lastly, plug assembly 14 may then be coupled to terminal 16 of compressor 18. Specifically, receptacles 46 are aligned with terminals 26, and plug assembly 14 is pressed into fence 32 to seat plug assembly 14 against terminal 16. Then, if desired, a plug retainer (not shown) may be used to removably lock plug assembly 14 to terminal 16.

The above-noted configuration provides a simple and effective way to couple a wiring conduit 12 and plug assembly 14. Further, the above-noted configuration assists in maintaining a moisture-free and dust-free electrical pathway between a power source and the compressor 18. In this regard, the first and second threaded surfaces 76 and 80 of conduit adapter 10 assist in preventing the entry of moisture and debris into conduit 12 when threadingly engaged with coupling 60 and conduit 12, respectively. Further, by providing sealing member or O-ring 70 between coupling 60 and conduit adapter 10, the additional prevention of moisture and debris from entering conduit 12 is achieved.

Now referring to FIGS. 7 to 10, another plug assembly **14*a* for use with another fence 32*a* according to a second aspect of the present disclosure is illustrated. Plug assembly 14*a* is similar to plug assembly 14 described above. In this regard, plug assembly 14*a* includes features such as a molded outer body 42 that surrounds an inner core 44 (not shown in FIGS. 7-10) that are formed of rigid and flame-resistant materials such as polyethylene terephthalate, polyamide 4, 6, and polyamide 6, 6 that may include a glass fiber filler, and includes features such as a conduit adapter 10, conduit 12, wires 40, receptacles 46, end cap 48, connector body 50, housing 52, and coupling 60 (not shown in FIGS. 7-9). Thus, description of these common features will be omitted here. The primary difference between plug assembly 14*a* is the manner in which plug assembly 14*a* is secured to fence 32*a***.

More particularly, plug assembly **14*a* includes a latching device 106 that is configured to mate with a through-hole 108 formed in fence 32*a*. Latching device 106 is an elongate member having a proximal first end 110 attached to end cap 48 and a distal second end 112. Distal second end 112 is spaced apart from connector body 50 such that latching device 106 may flex or deflect when plug assembly 14*a* attaches to fence 32*a*. Although not required by the present disclosure, proximal first end 110 may be located nearer to connector body 50 than distal second end 112. In other words, latching device 106 may gradually taper from proximal first end 110 toward distal second end 112. It should also be understood that connector body 50 may also taper away from latching device 106 such that a diameter of connector body 50 at end cap 48 is greater than a diameter of connector body 50 at a distal end 50*a*** thereof.

In addition, second end 112 includes a protrusion 114 for securing latching device 106 to through-hole 108 of fence **32*a*. Protrusion 114 includes a curved surface 116 for allowing protrusion 114 to more easily pass into fence 32*a* during engagement of plug assembly 14*a* with terminals 26, and a planar surface 118 that upon engagement between protrusion 114 and through-hole 108 will prevent disengagement between plug assembly 14*a* and terminals 26 until latching device 106 is depressed from through-hole 108**.

Figure 10:
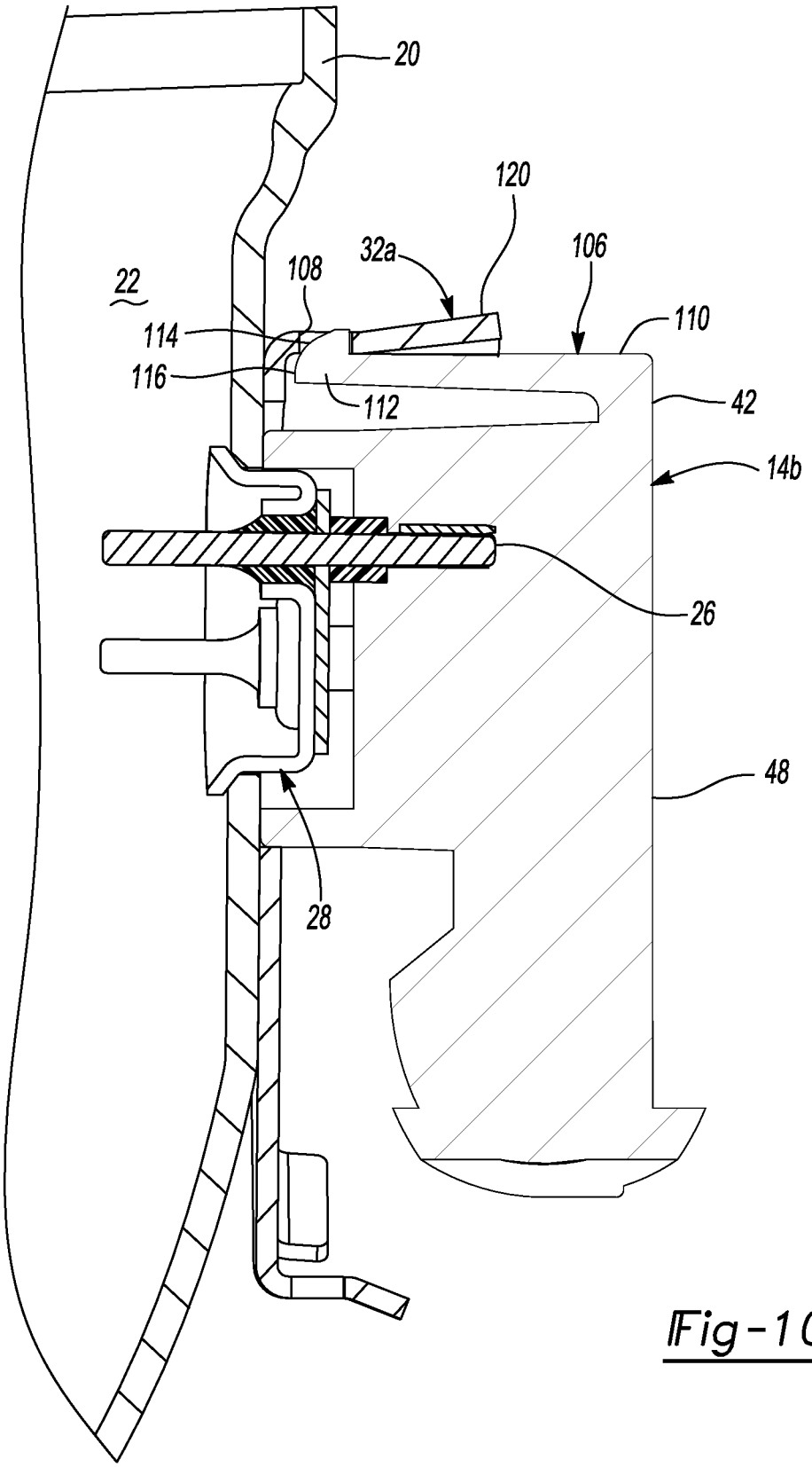
FIG. 10 is a cross-sectional view of the plug assembly illustrated in FIG. 7 attached to the compressor shell and terminal assembly illustrated in FIG. 8.

As best shown in FIG. 10, fence **32*a* includes a substantially rectangular-shaped through-hole 108 for mating with protrusion 114. In addition, fence 32*a* may include a hood portion 120 that is upwardly angled relative to an outer peripheral surface 122 of fence 32*a*. Hood portion 120 provides greater ease of allowing latching device 106 to pass beneath fence 32*a* before mating with through-hole 108. Fence 32*a* may be physically secured to the outside of the shell 20 by resistance welding and/or any other suitable attachment method. In this regard, the terminal body 28 and the fence 32*a* may be simultaneously or sequentially welded to the shell 20 to provide a hermetic seal. The fence 32*a* may extend outward from the shell 20 and may at least partially surround the conductor pins 26. The fence 32*a* may include a cavity 38 within which the conductor pins 26 may be located. Attachment between the fence 32*a* and the plug assembly 14*a* provides a seal that restricts or prevents moisture and/or debris from leaking therebetween and causing corrosion of the conductor pins 26. To disengage plug assembly 14*a* from fence 32*a*, an operator must depress protrusion 114 through through-hole 108 using a finger or tool while pulling plug assembly 14*a* in a direction away from fence 32*a***.

Now referring to FIGS. 11-15, a plug assembly **14*b* and fence assembly 32*b* according to a third aspect of the present disclosure is illustrated. Plug assembly 14*b* is similar to plug assemblies 14 and 14*a* described above. In this regard, plug assembly 14*b* includes features such as a molded outer body 42 that surrounds an inner core 44 (not shown in FIGS. 11-15), and includes features such as a conduit adapter 10, conduit 12, wires 40, receptacles 46, end cap 48, connector body 50, housing 52, and coupling 60 (not shown in FIGS. 11-15). Thus, description of these common features will be omitted here. The primary difference between plug assembly 14***b* and plug assembly 14*a* is the manner in which plug assembly 14*b* is secured to fence 32*b*.

More particularly, connector body 50 of plug assembly 14*b* includes a latching device 106*a* in the form of a pair of deflectable ears 122 that are configured to mate with a pair of through-holes 124 formed in fence 32*b*. In this regard, deflectable ears 122 are formed on opposing sides of connector body 50, and each include a proximal first end 126 connected to connector body 50, and a distal second end 128. Distal second ends 128 are spaced apart from connector body 50 such that ears 122 may deflect in a direction toward connector body 50 during engagement of plug assembly 14*b* and fence 32*b*. Further, ears 122 are angled relative to connector body 50 such that an outer surface 130 of ears 122 acts as a bearing surface between plug assembly 14*b* and fence 32*b*. Ears 122 may be oriented at an angle that ranges between 10 degrees and 45 degrees relative to a peripheral surface 132 of connector body 50. A terminal face 134 of distal second ends 128 that faces end cap 48 is essentially parallel with end cap 48, and acts as an abutment surface that prevents disengagement of plug assembly 14*b* when ears 122 are mated with through-holes 124. To ensure that ears 122 are flexible, molded outer body 42 is preferably formed of a less rigid material that than used for plugs 14 and 14*a*. In this regard, plug 14*b* may be formed of a material such as polyvinyl chloride (PVC) that is less rigid and more pliable than materials such as polyethylene terephthalate or polyamide.

Figure 11:
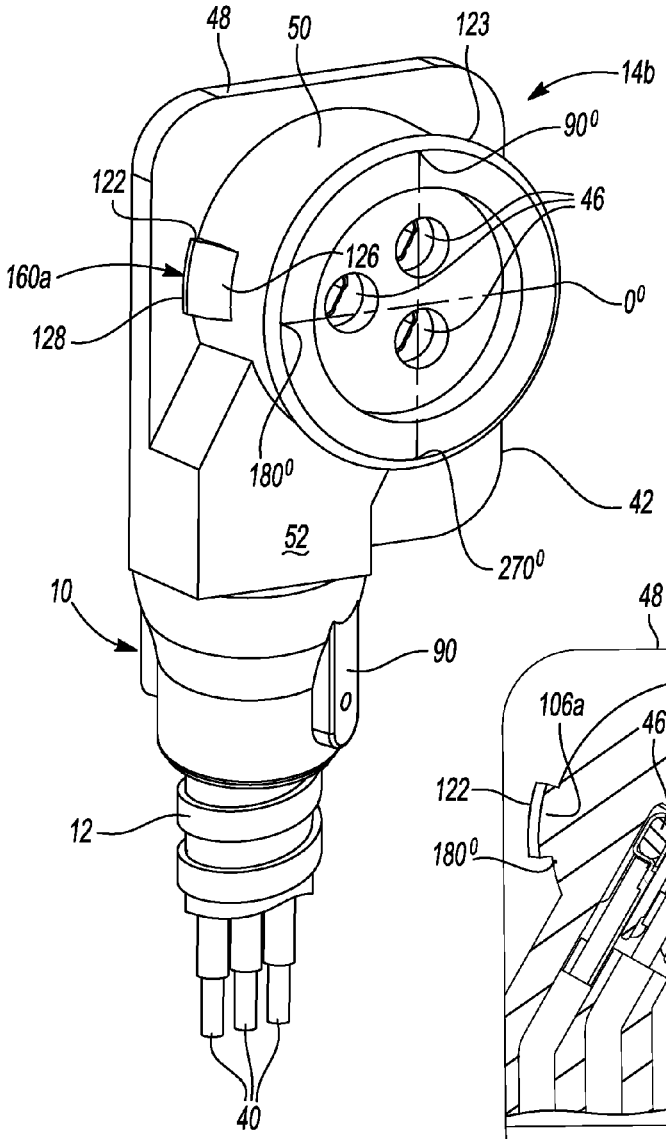
FIG. 11 is a perspective view of a plug assembly including a conduit adapter according to a third aspect of the present disclosure.
Figure 12:
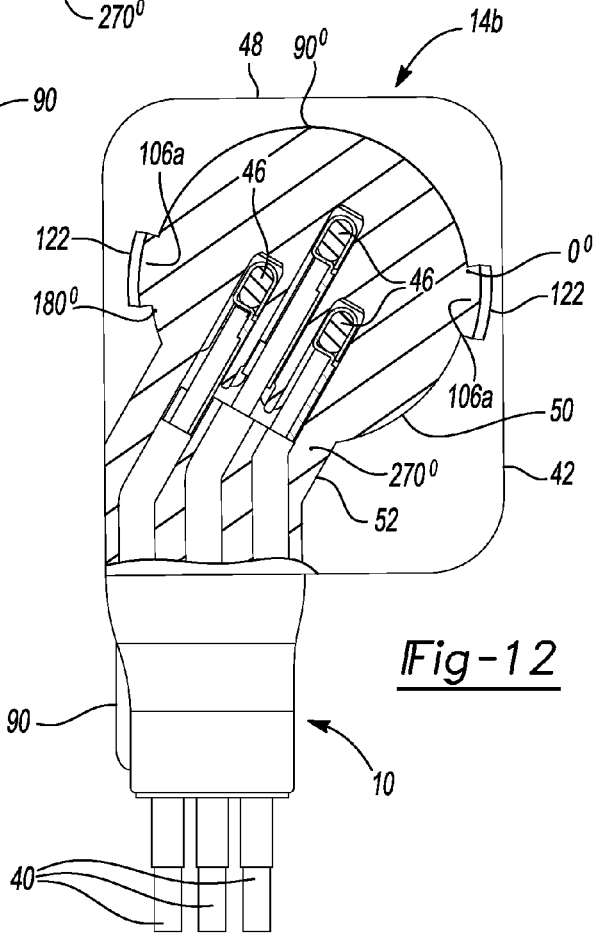
FIG. 12 is a cross-sectional view of the plug assembly illustrated in FIG. 11.
Figure 13:
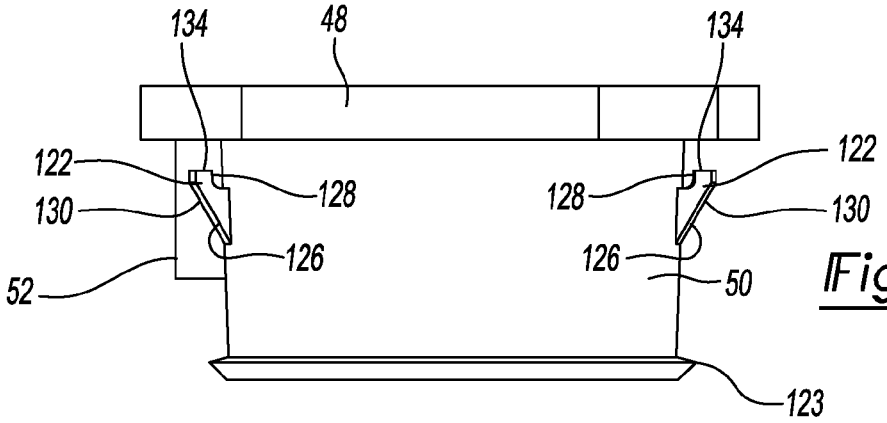
FIG. 13 is a top-perspective view of the plug assembly illustrated in FIG. 9.
Figure 14:
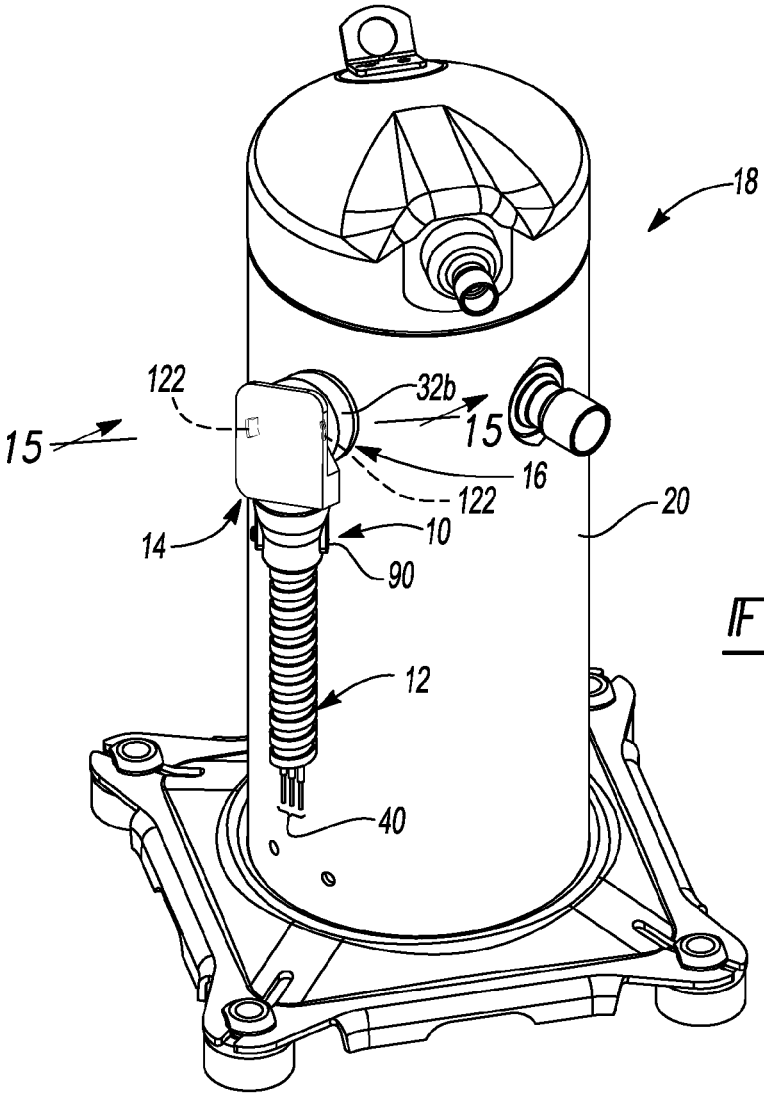
FIG. 14 is a perspective view of the plug assembly illustrated in FIG. 11 attached to an example compressor.
Figure 15:
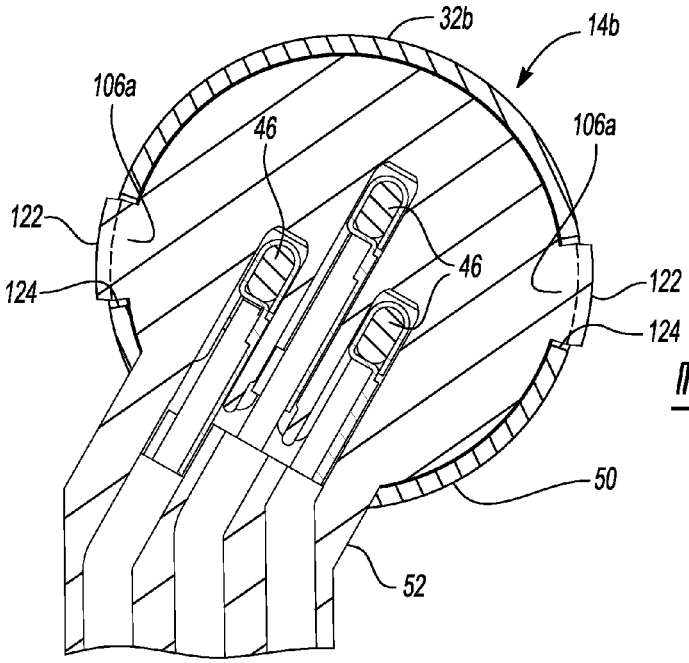
FIG. 15 is a cross-sectional view of the plug assembly attached to the example compressor illustrated in FIG. 14.
Figure 16:
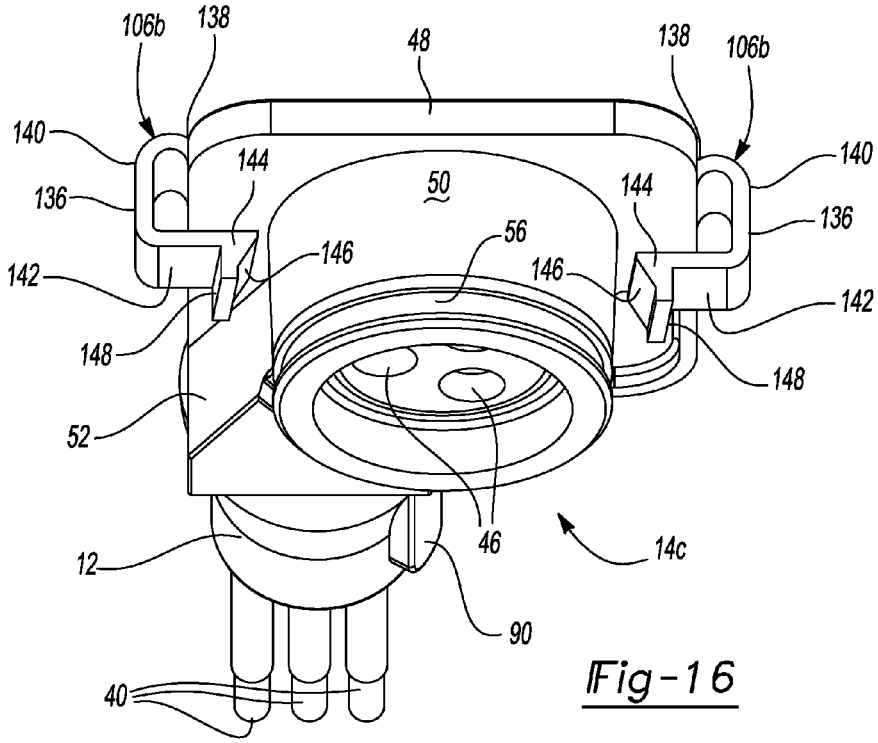
FIG. 16 is a perspective view of a plug assembly including a conduit adapter according to a fourth aspect of the present disclosure.

As best shown in FIGS. 11 and 12, although ears 122 are positioned on opposing sides of connector body 50, ears 122 are slightly offset from positions of zero degrees and 180 degrees about cylindrical connector body 50. Slightly offsetting ears 122 relative to positions of zero degrees and 180 degrees further assists in preventing disengagement of plug 14*b* from fence 32*b*. It should be understood, however, that ears 122 may be located at positions of zero degrees and 180 degrees, or any other locations about connector body 50 without departing from the scope of the present disclosure.

Fence 32*b* is substantially similar to fence 32 illustrated in FIG. 1. As noted above, however, fence 32*b* includes through-holes 124 on opposing sides thereof that are configured to mate with ears 122. Similar to ears 122 being slightly offset from positions of zero degrees and 180 degrees, through-holes 124 are located in similar positions about fence 32*b* to correspond to the locations of ears 122. Fence 32*b* may be physically secured to the outside of the shell 20 by resistance welding and/or any other suitable attachment method. In this regard, the terminal body 28 and the fence 32*b* may be simultaneously or sequentially welded to the shell 20 to provide a hermetic seal. The fence 32*b* may extend outward from the shell 20 and may at least partially surround the conductor pins 26.

Attachment between the fence 32*b* and the plug assembly 14*b* provides a seal that restricts or prevents moisture and/or debris from leaking therebetween and causing corrosion of the conductor pins 26. In this regard, plug 14*b* may include an integral sealing lip 123 to seal against fence 32*b*. Because outer body 42 is formed from a softer material such as PVC, sealing lip 123 is more apt to prevent moisture and/or debris from contacting conductor pins 26. To disengage plug assembly 14*b* from fence 32*b*, an operator must depress ears 122 through through-holes 124 using a pair of fingers or tool while pulling plug assembly 14*b* in a direction away from fence 32*b*.

Now referring to FIGS. 16-19, a plug assembly 14*c* is illustrated. Plug assembly 14*c* is similar to plug assemblies 14, 14*a*, and 14*b* described above. In this regard, plug assembly 14*c* includes features such as a molded outer body 42 that surrounds an inner core 44 (not shown in FIGS. 16-19), and includes features such as wires 40, receptacles 46, end cap 48, connector body 50, and housing 52. Thus, description of these common features will be omitted here. The primary difference between plug assembly 14*c* and plug assemblies 14*a* and 14*b* is the manner in which plug assembly 14*c* is secured to fence 32*b*.

More particularly, end cap 48 of plug assembly 14*c* includes a latching device 106*b* in the form of a pair of deflectable arms 136 that are configured to mate with the pair of through-holes 124 formed in fence 32*b*. In this regard, deflectable arms 136 are formed on opposing sides of end cap 48, and each include a proximal first end 138 connected to end cap 48, a hinge portion 140, and a distal second end 142. Proximal first end 138 directs arms 136 away from end cap 48, while hinge portions 140 direct arms 136 in a direction back toward end cap 48 and connector body 50 such that arms 136 will wrap around fence 32*b*. Distal second ends 142 are directed toward connector body 50. Due to hinge portions 140, distal second ends 142 are permitted to move towards and away from connector body 50. Thus, distal second ends 142 are spaced apart from connector body 50.

Distal second ends 142 each include a protrusion 144 for securing latching device 106*b* to through-holes 124 of fence 32*b*. Protrusions 144 includes an angled surface 146 for allowing protrusions 144 to more easily pass into through-holes 124 during engagement of plug assembly 14*c* with fence 32*b*, and a planar surface 148 that upon engagement between protrusion 144 and through-hole 124 will rest against fence 32*b*. It should be understood that angled surface 146 may be replaced with curved surface 116 without departing from the scope of the present disclosure. Regardless, to attach plug assembly 14*c* to fence 32*b*, arms 136 are initially moved away from connector body 50 to wrap around fence 32*b*. Then, distal second ends 142 and protrusions 144 are urged toward through-holes 124 of fence 32*b* to engage protrusions 144 with through-holes 124.

Figure 17:
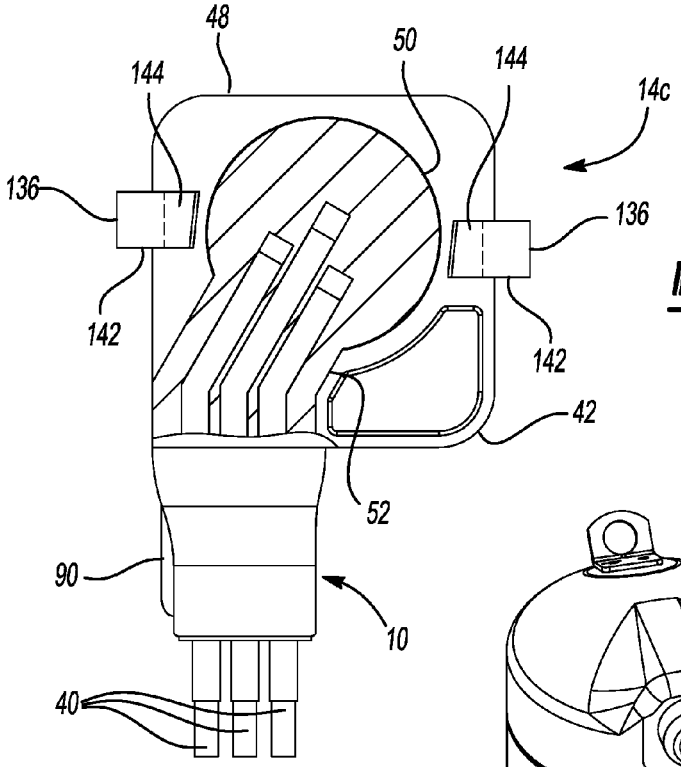
FIG. 17 is a partial cross-sectional view of the plug assembly illustrated in FIG. 16.
Figure 18:
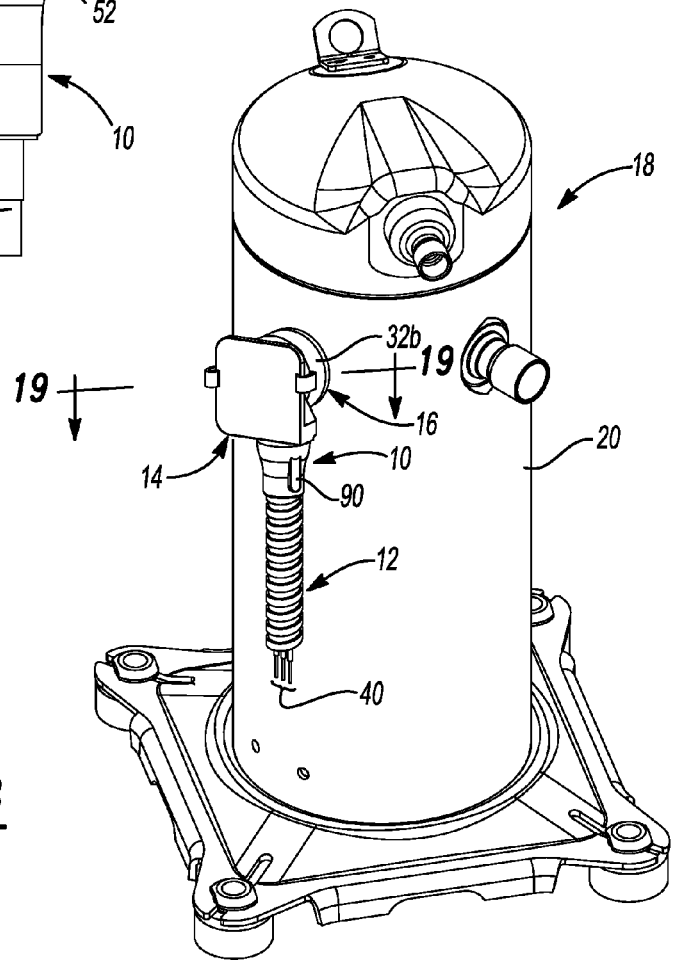
FIG. 18 is a perspective view of the plug assembly illustrated in FIG. 16 attached to an example compressor.
Figure 19:
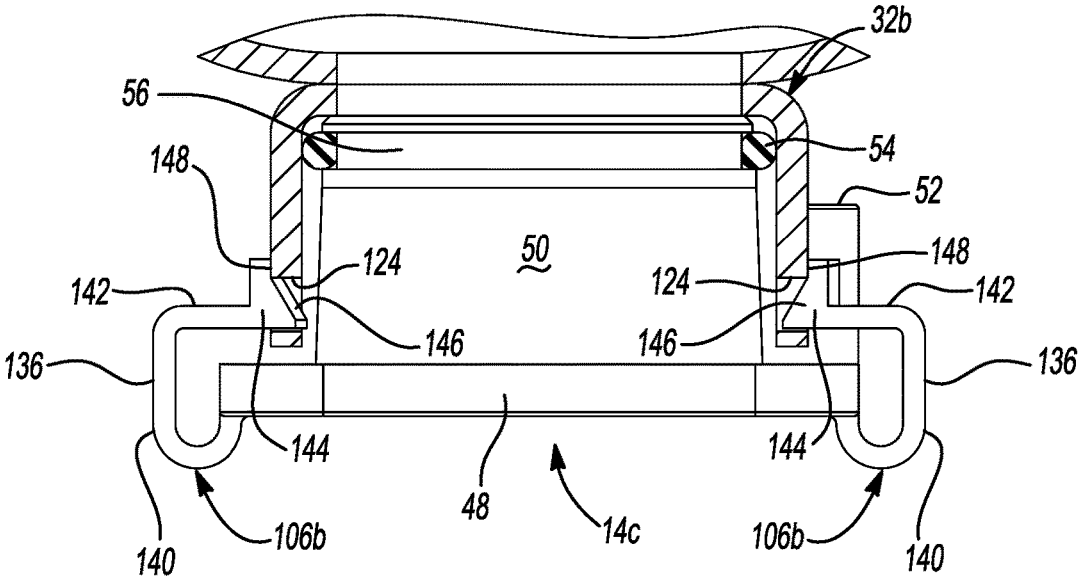
FIG. 19 is a cross-sectional view of the plug assembly attached to the example compressor of FIG. 18.

Similar to ears 122, and as best shown in FIG. 17, it can be seen that arms 136 are slightly offset from locations of zero degrees and 180 degrees about cylindrical connector body 50. Slightly offsetting arms 136 relative to positions of zero degrees and 180 degrees further assists in preventing disengagement of plug 14*c* from fence 32*b*. It should be understood, however, that arms 136 may be located at positions of zero degrees and 180 degrees, or any other locations about connector body 50 without departing from the scope of the present disclosure.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An assembly comprising:

a plug body encasing a plurality of electrical receptacles and first ends of a plurality of wires electrically connected to the electrical receptacles, the plug body including a threaded coupling unitary therewith;

a conduit adapter including a first threaded surface for engagement with the threaded coupling, and a second threaded surface; and a threaded conduit engaging the second threaded surface to allow the plurality of wires to extend from the plug body, through the conduit adapter, and into the threaded conduit.

2. The assembly of claim 1, wherein the electrical receptacles in the plug body are configured to receive a respective one of a plurality of conductor pins extending from an electrical terminal to provide electrical communication between the plurality of wires and the plurality of conductor pins.

3. The assembly of claim 1, further comprising a sealing member between the conduit adapter and the threaded coupling.

4. The assembly of claim 1, wherein the threaded coupling includes a threaded outer body, and a radially extending flange that is configured for receipt of the sealing member.

5. The assembly of claim 1, further comprising a bushing between the conduit adapter and the conduit.

6. A compressor comprising the assembly of claim 1, the assembly being connected to a terminal extending through a shell of the compressor.

7. The assembly of claim 1, wherein the conduit adapter includes a pair of elongate ribs extending from an exterior surface thereof.

8. The assembly of claim 7, wherein at least one of the elongate ribs includes an aperture configured for receipt of a fastener that secures the conduit adapter to the conduit.

9. A compressor comprising:

a shell including an opening;

an electrical terminal engaging said opening and including a fence at least partially surrounding a plurality of first electrically conductive members;

a plug including a plurality of second electrically conductive members in electrical communication with said first electrically conductive members, the plug including a threaded coupling unitary therewith;

a plurality of wires extending from said second electrically conductive members through the threaded coupling;

a conduit adapter including a first threaded surface for engagement with the threaded coupling, and a second threaded surface; and a threaded conduit engaging the second threaded surface to allow the plurality of wires to extend from the plug body, through the conduit adapter, and into the threaded conduit.

10. The assembly of claim 9, wherein the electrical receptacles in the plug body are configured to receive a respective one of a plurality of conductor pins extending from an electrical terminal to provide electrical communication between the plurality of wires and the plurality of conductor pins.

11. The assembly of claim 9, wherein the threaded coupling includes a threaded outer body, and a radially extending flange that is configured for receipt of the sealing member.

12. The assembly of claim 9, further comprising a bushing between the conduit adapter and the conduit.

13. The assembly of claim 9, wherein the conduit adapter includes a pair of elongate ribs extending from an exterior surface thereof.

14. The assembly of claim 13, wherein at least one of the elongate ribs includes an aperture configured for receipt of a fastener that secures the conduit adapter to the conduit.

15. The assembly of claim 14, further comprising a sealing member between the conduit adapter and the threaded coupling.

16. An assembly comprising:

a terminal body including a plurality of conductor pins;

a fence having a through-hole formed therein, the fence surrounding the terminal body;

a plug body encasing a plurality of electrical receptacles for engagement with the plurality of conductor pins;

a latching device extending from the plug body and configured to engage with the through-hole of the fence to secure the plug body to the fence and prevent disengagement between the plurality of conductor pins and plurality of electrical receptacles;

a plurality of wires electrically connected to the electrical receptacles, and passing through a threaded coupling unitary with the plug body;

a conduit adapter including a first threaded surface for engagement with the threaded coupling, and a second threaded surface; and a threaded conduit engaging the second threaded surface to allow the plurality of wires to extend from the plug body, through the conduit adapter, and into the threaded conduit.

17. The assembly of claim 16, wherein the plug body includes a connector body having the plurality of electrical receptacles, and a planar end cap attached to the connector body.

18. The assembly of claim 17, wherein the latching device includes an elongate member having a proximal first end attached to the planar end cap, and a distal second end defining a protrusion and spaced apart from the connector body for engagement with the through-hole of the fence.

19. The assembly of claim 18, wherein the elongate member is flexible relative to the connector body.

20. The assembly of claim 17, the latching device includes a proximal first end attached to the planar end cap, a hinge portion connected to the first end, and a distal second end connected to the hinge portion and defining a protrusion, the distal send end portion being configured to engage with the through-hole of the fence.

21. The assembly of claim 20, wherein the hinge portion is configured to allow the distal second end to move towards and away from the connector body.

22. The assembly of claim 17, wherein the latching device includes a deflectable ear having a proximal first end attached to the connector body, and a distal second end spaced apart from the connector body for engagement with the through-hole of the fence.

23. The assembly of claim 22, further comprising another deflectable ear connected to an opposing side of the connector body, and configured to engage with a second through-hole formed on an opposing side of the fence.

* * * * *